US005226488A

United States Patent [19]

Lessard et al.

[11] Patent Number: 5,226,488

[45] Date of Patent: Jul. 13, 1993

[54] TRUCK MOUNTED BORING SYSTEM

[75] Inventors: Willie J. Lessard, Forest Lake; Brian B. Wilcox, White Bear Lake, both of Minn.; Michael H. Tjader, New Richmond, Wis.

[73] Assignee: bor-mor Inc., Lino Lakes, Minn.

[21] Appl. No.: 728,202

[22] Filed: Jul. 10, 1991

[51] Int. Cl.[5] ..... E21C 5/06; E21B 7/02

[52] U.S. Cl. ..... 175/61; 173/147; 173/192; 175/162; 175/393

[58] Field of Search ..... 173/25, 42, 44, 147; 175/19, 21, 45, 61, 89, 113, 121, 122, 162, 393

[56] References Cited

U.S. PATENT DOCUMENTS

| | | | |
|---|---|---|---|
| Re. 32,267 | 10/1986 | Cherrington | 175/53 |
| 2,365,749 | 12/1944 | Curtis | 173/147 X |
| 2,646,968 | 7/1953 | Curtis | 173/44 X |
| 3,876,350 | 4/1975 | Warder | 175/107 X |
| 3,974,886 | 8/1976 | Blake, Jr. | 175/76 |
| 4,449,595 | 5/1984 | Holbert | 175/79 |
| 4,456,080 | 6/1984 | Holbert | 175/61 |
| 4,582,147 | 4/1986 | Dardick | 175/1 |
| 4,596,294 | 1/1986 | Russell | 175/74 |
| 4,615,401 | 10/1986 | Garrett | 175/230 |
| 4,637,479 | 1/1987 | Leising | 175/26 |
| 4,674,579 | 6/1987 | Geller et al. | 175/45 |
| 4,679,637 | 7/1987 | Cherrington et al. | 175/61 |
| 4,739,841 | 4/1988 | Das | 175/61 |
| 4,764,036 | 8/1988 | McPherson | 175/73 X |
| 4,881,605 | 11/1989 | Warren et al. | 175/320 |
| 5,000,271 | 3/1991 | Uitto et al. | 173/42 X |
| 5,148,880 | 9/1992 | Lee et al. | 175/393 |

*Primary Examiner*—David J. Bagnell
*Attorney, Agent, or Firm*—Leone & Moffa

[57] ABSTRACT

A truck mounted boring system providing a high degree of radial and longitudinal freedom. The system provides a method of quickly setting up a boring system used for directional drilling of underground cabling bore holes. A hydraulic system providing power to the boring system is run by a power take off of a truck. The truck is used to position the boring system. The boring system employs a rotatably mounted hydraulic actuator which radially and axially changes the orientation of the drilling system. The drill bit is driven into a boring hole using a linear chain drive. The chain drive is mounted on a boring platform that can achieve motion relative to the truck or drive the drill toward the bore hole in response to a restraining bar.

24 Claims, 2 Drawing Sheets

TRUCK MOUNTED BORING SYSTEM

This invention relates to a method of boring and more particularly to a method of directional drilling for underground cabling.

BACKGROUND OF THE INVENTION

Prior art solutions for directional drilling have included the Easy Bore fluid boring system from Vermeer Corporation of Iowa. The Easy Bore fluid boring system is a boring rig attached to a wheel for movement and a stand. The Easy Bore system has a length of 160 inches and maximum drill angles of 10°-20°. The operating weight is roughly 1000 lbs. It incorporates a simple chain-driven borer.

Another directional drilling system is available from Underground Technologies, Inc. of Byron Calif. The system is called the GBS directional drilling system family. The GBS family of drilling systems provides a portable unit that provides its own means of locomotion via a set of tank-like treads where the guided boring system is wheeled to the spot. A chain-driven boring drill is used to affect the drilling. The GBS family of directional drilling systems are limited in their ability to provide remote power and can not accomplish large changes in directional drilling angles.

An alternative directional drilling system is available from Auger's Unlimited, Inc. of Ashland, Ohio. The Drill Master directional drilling machine model DDU-10 is a system providing a chain-driven boring system that is able to be wheeled to the spot of drilling. The Drill Master is both limited in power and in changes of angle of drilling.

Prior art directional drilling systems also require extensive set up time which contributes to increasing costs of operation.

It is therefore the motive of the invention to provide a more flexible and powerful directional drilling system that can drill at a wide range of angles and that is more easily set up with a minimum of operator intervention.

SUMMARY OF THE INVENTION

The invention provides a means of accurately changing the directional drilling angle of a boring system. The invention utilizes a linear drive which is slidably mounted on a fixture that can be rotated in a plane relative to the earth and can be rotated to tilt with respect to the bore hole. The apparatus of the invention provides a wide range of boring angles and ease of set up.

It is one object of the invention to provide an improved truck mounted boring system.

It is yet another object of the invention to provide an improved truck mounted boring system that allows boring at a wide range of angles from vertical to horizontal.

It is yet a further object of the invention to provide a truck mounted boring system that utilizes the high power of a truck diesel engine through a power take off to power a hydraulic system.

It is yet a further object of the invention to provide a self contained, improved, truck mounted boring system that utilizes the power of an on-site vehicle.

It is yet a further object of the invention to provide an improved truck mounted boring system that utilizes a hydraulic actuator to raise and lower the drill shaft.

It is yet a further object of the invention to provide a truck mounted boring system that has a steering head that does not immerse a commercially available "Sonde" transmitter in water.

It is yet a further object of the invention to provide a steering head that fits on a truck mounted boring system.

Other objects, features and advantages of the present invention will become apparent to those skilled in the art through the Description of the Preferred Embodiment, Claims, and Drawings herein wherein like numerals refer to like elements.

BRIEF DESCRIPTION OF THE DRAWINGS

To illustrate this invention, a preferred embodiment will be described herein with reference to the accompanying drawings. The preferred embodiment concerns an apparatus for truck mounted boring.

DETAILED DESCRIPTION OF THE PREFERRED EMBODIMENT

Figure 1:
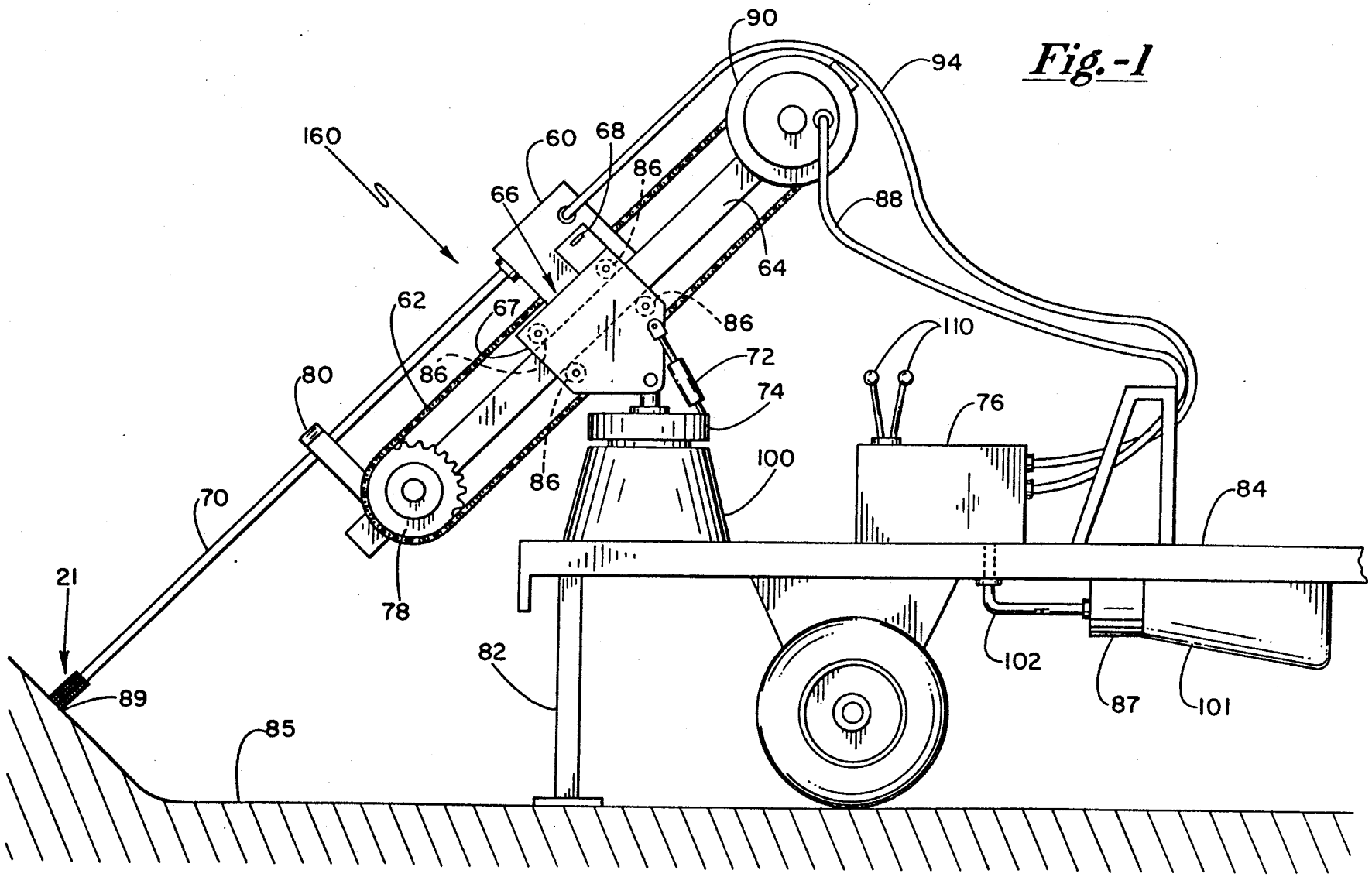
FIG. 1 shows a schematic diagram of the truck mounted boring system as shown as a side view.
Figure 2:
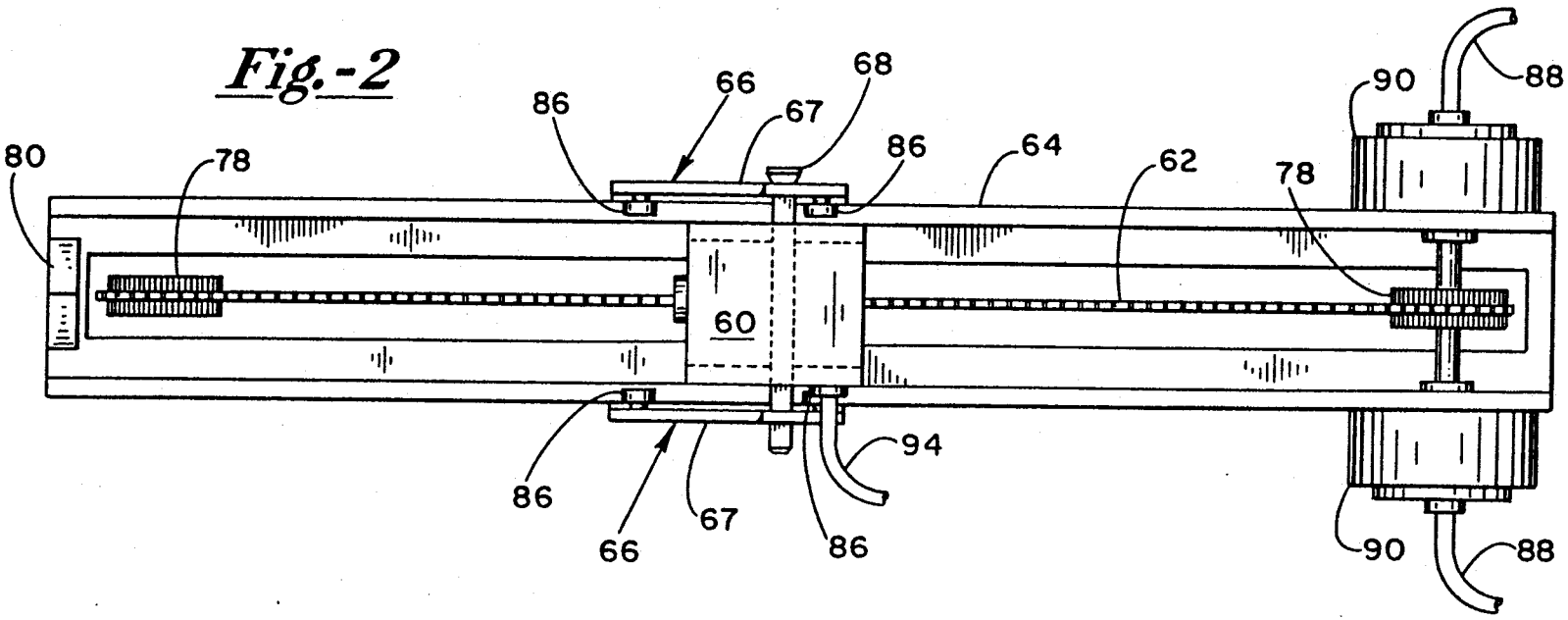
FIG. 2 shows a schematic drawing of the truck mounted boring system apparatus of the invention shown as a top view.

Referring now to FIGS. 1 and 2 which show a cross section diagram of the truck mounted boring system 160 of the apparatus of the invention from the side, FIG. 1 and the top, FIG. 2. The truck mounted boring system 160 comprises a number of sliding parts actuated using a hydraulic power system 76. FIG. 1 also shows the method of the invention equipped with the drill bit assembly 21 of the invention. The truck mounted boring system 160 is mounted on a truck 84 which provides both a base for the boring system and inertial mass to resist the force of drilling.

The truck 84 provides a mechanism by which the boring system 160 can be positioned. The boring system 160 is mounted on the rear of the truck 84 and can be maneuvered with the great degree of latitude enjoyed by the truck 84. The truck 84 can be driven to a boring location. To accomplish more accurate positioning and angling of the drilling apparatus, the truck mounted boring system's hydraulic system 76 can be used. The hydraulic system is powered with the truck's engine 101 which provides hydraulic power from a power take-off 87 through hydraulic line 102. In one embodiment of the apparatus of the invention the truck 84 is a commercially available heavy-duty Ford truck which comes equipped with a diesel engine 101 which also includes a power take-off 87.

The power take-off runs the hydraulic system 76 through line 102 which provides hydraulic pressure to hydraulic lines 94 and 88. Hydraulic line 94 is connected to a hydraulic drilling motor 60 which turns the drill shaft 70. The hydraulic drilling motor 60 is hydraulically powered by the hydraulic system 76. The second hydraulic line 88 powers a chain drive hydraulic motor or thrust motor 90 which drives a driving chain 62.

The driving chain 62 and hydraulic drilling motor 60 and chain drive hydraulic motor or thrust motor 90 are attached to a drill platform 64. The driving chain 62 moves over a driving chain sprocket 78. The drill platform 64 is slidably mounted within a drill platform fixture 66 on rollers 86. The rollers 86 are attached to the drill platform fixture 66. The drill platform fixture 66 is rotatably mounted on a swivel 74 attached to the truck mount 100. The swivel 74 provides a mechanism by which the entire boring system 160 can be rotated in relation to the truck 84. The drilling shaft 70 and drill bit assembly 21 is guided by a front guide 80 which is mounted on the drill platform 64.

The drill platform 64 is positioned between and fastened in two dimensions by slide rollers 86. The rollers 86 are positioned opposite each other and the drill platform 64 slides between them so as to substantially slide in a linear fashion. Those skilled in the art will appreciate that the use of rollers are by way of illustration and not by limitation and that other linear actuating devices may also be employed without deviating from the scope and spirit of the invention. The rollers are attached to two plates 67, one on each side of the boring platform 64. Each plate 67 holds one side of the boring platform 64. The plates 67 are connected to the truck 84 on a swivel mount 74. The drill platform fixture 66 is also attached to the swivel mount through hydraulic actuating cylinders 72. The hydraulic actuating cylinders 72 act to raise and lower the drill platform fixture 66 which in turn causes the drill platform 64 to raise or lower. The hydraulic actuators 72 provide a method of changing the drill angle in relationship to the truck 84 and therefore in relationship to the ground 85. The entire assembly is controlled through hydraulic control system 76 that allows the operator of the truck mounted boring system 160 to maneuver the system into the proper boring orientation. Hydraulic control system 76 and power take-off 87 comprise standard control and power elements well known in the art.

Now that the structure and features of the truck mounted boring system have been described the operation of the apparatus of the invention will now be disclosed to promote further understanding of the invention. To operate the truck mounted boring system of the apparatus of the invention the operator first positions the truck 84 into the approximate location of the underground bore hole to be excavated. After being maneuvered into position the truck mounted boring system is then secured into position by the truck stabilizer bars 82. After being moved into position the truck mounted boring system 160 of the apparatus of the invention is aligned with the boring hole 89 to be drilled. The operation of the truck mounted boring system is illustrated in FIG. 1 as directionally drilling a hole in the ground 85 through bore hole 89 with drill bit assembly 21. The operator of the apparatus of the invention is able to adjust the relative position of both the drilling shaft 70 and drill bit assembly 21 in relation to both the truck 84 and the ground 85 using controls 110 on the hydraulic system 76.

Adjustments of the truck mounted boring system 160 can be accomplished in a number of ways. The entire apparatus can be rotated on swivel 74. This accomplishes a rotational displacement of the drill shaft 70 in relation to the earth 85 and the truck 84. The next adjustment is available through the use of the hydraulic actuator 72 which provides a method of changing the relative angle of the drilling platform 64 with the truck 84 and the earth 85 and the bore hole 89. While directionally drilling the bore hole 89 the operator can carefully control the angle of attack of the both the drill shaft 70 and the drill bit assembly 21 with the earth 85 by changing or adjusting the angle of the drill platform 64 with the hydraulic actuators 72. The hydraulic actuators 72 are attached to, and can rotate with, the drill platform fixture 66.

The truck mounted boring system 160 of the apparatus of the invention also has additional adjustments that may be made for shaft 70 insertion and shaft 70 drive. Each adjustment can be accomplished in a number of different ways. First the manually inserted retaining bar 68 is used to secure the hydraulic drilling motor 60 to the drill platform fixture 66 through slots in the side plate 67. This permits the hydraulic drilling motor 60 to be fixed in relation to the truck 84 and the drill platform fixture 66. Since the hydraulic drilling motor 60 is fastened to the drive chain 62 any relative motion of the drive train will translate to the motion of the drill platform 64 in relation to the drill platform fixture 66. Thus, with the retaining bar 68 in place, a rotation of the thrust motor 90 will cause the chain to rotate in relation to the drill platform 64 and since the chain is fixed in relation to the drill platform fixture 66 the drill platform 64 moves. Since the drill platform is restrained by the rollers 86 it can move only in a linear fashion in an axis parallel to the drill shaft 70.

With the restraining bar 68 removed however, the rotation of the thrust motor 90 will cause the hydraulic drilling motor 60 to move along with the chain and since the hydraulic drilling motor 60 is no longer fastened to the drill platform fixture 66 it will move in relation to both the drill platform fixture 66 and the drill platform 64. This accomplishes relative motion of the drill shaft 70 with respect to the earth 85 and tends to drive the drill bit assembly 21 into the earth through bore hole 89. As the drilling rig is operating the hydraulic drilling motor rotates the drill shaft 70 and thus the drill bit assembly 21 causing boring action. The dynamic characteristics of the truck mounted boring system 160 provides superior flexibility in drill orientation and drill bit approach. One skilled in the art can appreciate that the truck mounted boring system 160 of the method of the invention can be used to bore holes at a wide variety of drilling angles in relation to the truck 84 and the earth 85 and a wide variety of drill shaft configurations and drill approaches and boring approaches.

Figure 3:
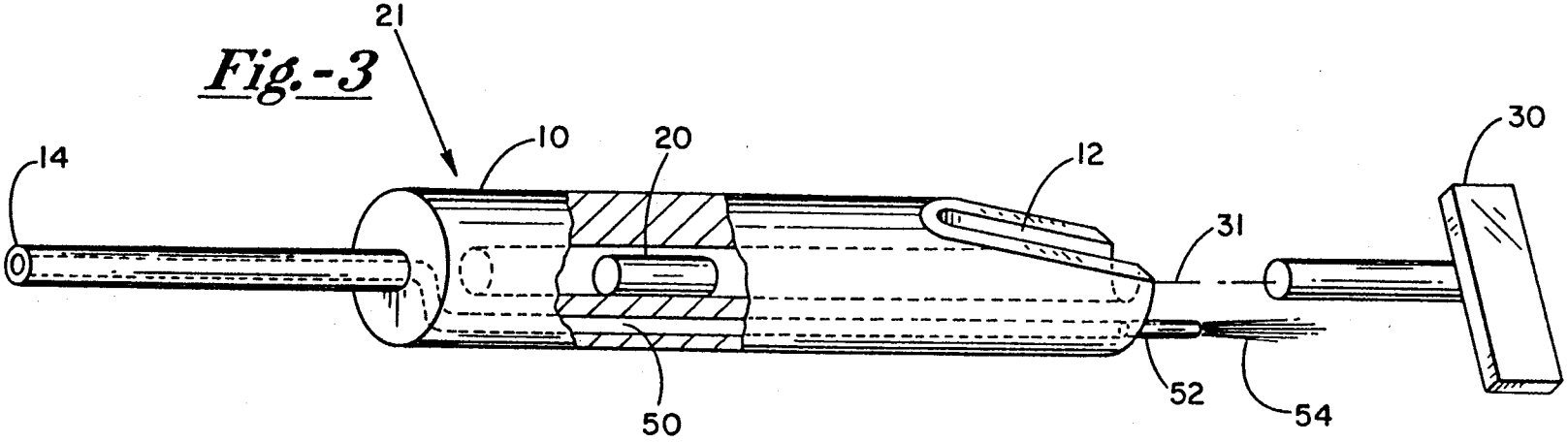
FIG. 3 shows a three dimensional schematic diagram of the drill bit assembly used in the truck mounted boring system showing supply cavities for cooling, cutting and lubricating fluid.

Now referring to FIG. 3 which shows a schematic view of the drill bit holding and steering apparatus 21 of the truck mounted boring system of the apparatus of the invention. The drill bit holder 10 is a shaft mountable drill bit holder which enables the cooling, cutting and lubricating fluid to pass by the drill bit holder 10 and bypass a "Sonde" device 20 which is located inside the drill bit holder. The "Sonde" device is a commercially available transmitter used for locating an underground drill bit. Those skilled the art will recognize that prior art solutions to drill bit holders have flooded the "Sonde" and the flooding has shortened the life of the "Sonde". The apparatus of the invention provides a cooling channel 50 which traverses the drill bit holder from the drill shaft mounting end 14 to the drill shoe opening 12 where the fluid exits port 52. The cooling channel travels down the side wall of the drill bit holder 10 and exits at port 52 where the cooling, cutting and lubricating fluid flows on the drill bit 30. The drill bit 30 is inserted in drill shoe opening 12. In the operation of the drill holder of the apparatus of truck mounted boring of the invention the drill is inserted along insertion lines 31 into the shoe of the drill bit holder 12. Thus the invention provides a mechanism which the "Sonde"

transmitter 20 can transmit without being immersed in the cooling, cutting and lubricating fluid 54.

The invention has been described herein in considerable detail in order to comply with the Patent Statutes and to provide those skilled in the art with the information needed to apply the novel principles and to construct and use such specialized components as are require. However, it is understood that the invention can be carried out by specifically different equipment and devices, and that various modifications, both by equipment details and operating procedures, can be accomplished without departing from the scope of the invention itself.

What is claimed is:

1. An earth hole boring system comprising:

a positioning means for moving the earth hole boring system;

a two axis rotating means for providing rotary motion in a first axis and a second axis, wherein the two axis rotating means includes a first axial motion control and a second axial motion control and wherein the two axis rotating means is attached to the positioning means;

a linear actuating means for providing linear motion having a linear motion control attached to the two axis rotating means;

a drill platform attached to the linear actuating means; and a drill rotating means for rotating a drill shaft wherein the drill rotating means is attached to the drill platform to substantially rotate the drill.

2. The earth hole boring system of claim 1 wherein all elements are mounted on the positioning means.

3. The earth hole boring system of claim 1 wherein the positioning means further comprises a power supply means for supplying motive power to the two axis rotating means, the linear actuating means, and the drill rotating means.

4. The earth hole directional boring system of claim 1 further comprising:

a. a drill bit holder attached to the drill shaft; and b. a drill bit attached to the drill bit holder.

5. The earth hole directional boring system of claim 4 wherein the drill bit holder comprises a hollow tubular member having a tubular wall, a drill shaft connection on one end, a bit receiving notch on the opposite end with a bit fluid outlet, a transmitter mount, and a fluid hole through one side of the tubular wall to substantially provide fluid through the fluid hole to the bit fluid outlet wherein the drill shaft connects to the drill shaft connection.

6. The earth hole directional boring system of claim 1 wherein the positioning means is a truck.

7. The earth hole directional boring system of claim 1 wherein the two axis rotating means comprises a hydraulic cylinder actuating arm for movement in the first axis and a pivot for movement in the second axis.

8. The earth hole directional boring system of claim 1 wherein the linear actuating means is a chain drive.

9. The earth hole directional boring system of claim 1 wherein the linear actuating means is a chain drive having two modes of operation in response to a restraint wherein the first mode provides linear motion of the drill platform with respect to the earth hole and the second mode provides linear motion of the drill rotating means with respect to the earth hole.

10. The earth hole directional boring system of claim 1 wherein the drilling rotating means further comprises a hydraulic motor.

11. The earth hole boring system of claim 1 further comprising a drill bit holder comprising a hollow tubular member having a tubular wall, a drill shaft connection on one end, a bit receiving notch on the opposite end with a bit fluid outlet, a transmitter mount, and a fluid hole through one side of the tubular wall to substantially provide fluid through the fluid hole to the bit fluid outlet.

12. An earth hole boring system comprising:

a truck having a base attached to one end;

a swivel attached to the base to provide motion in a angular direction substantially 360° around the base and wherein the swivel also comprises a fulcrum point;

a drill platform fixture having an engagable retaining means wherein the drill platform fixture is attached to the swivel at the fulcrum point;

a hydraulic cylinder attached both to the drill platform fixture at a predetermined distance away from the fulcrum point and attached to the swivel so as to substantially accomplish a radial movement of the drill platform fixture around the fulcrum point from the horizontal to the vertical;

a drill platform slidably mounted on the drill platform fixture having a drive end with a first flexible drive sprocket and a mount end with a second flexible drive sprocket;

a flexible drive attached to the first flexible drive sprocket and second flexible drive sprocket disposed to receive the retaining means when it is engaged;

a shaft rotation means attached to the flexible drive;

a drill shaft attached at one end of the shaft rotation means and slidably mounted in the mount end also comprising a drill bit end;

a flexible drive actuator attached to the first flexible drive sprocket to drive the flexible drive;

an engagement means for engaging the engagable retaining means such than when the retaining means is disengaged and the flexible drive actuator moves the flexible drive the drill shaft is disposed to move in relation to the drill platform and when the retaining means is engaged and the flexible drive actuator moves the flexible drive the drill platform moves in relation to the drill platform fixture; and a drill bit assembly attached to the drill bit end.

13. The earth hole boring system of claim 12 wherein all elements are mounted on the truck.

14. The earth hole boring system of claim 12 wherein truck further comprises a power take off for supplying motive power to the hydraulic cylinder, flexible drive actuator, and shaft rotation means.

15. The boring system of claim 12 wherein the drill bit assembly comprises a hollow tubular member having a tubular wall, a drill shaft connection on one end, a bit receiving notch on the opposite end with a bit fluid outlet, a transmitter mount, and a fluid hole through one side of the tubular wall to substantially provide fluid through the fluid hole to the bit fluid outlet.

16. The boring system of claim 12 wherein the flexible drive is a chain.

17. The boring system of claim 12 wherein the flexible drive actuator is a hydraulic chain drive.

18. The boring system of claim 12 wherein the flexible drive is a belt.

19. The boring system of claim 12 wherein the flexible drive actuator is a hydraulic belt drive.

20. The boring system of claim 12 wherein the flexible drive is a screw drive.

21. The boring system of claim 12 wherein the flexible drive actuator is a hydraulic screw drive.

22. The boring system of claim 12 wherein the drill platform fixture also comprises a first slot and the flexible drive also comprises a second slot wherein the engagement means is a slidably mounted retention bar disposed to fit in and through the first slot and second slot.

23. The boring system of claim 12 wherein the shaft rotation means comprises a hydraulic shaft drive.

24. The boring system of claim 12 wherein the shaft rotation means comprises an electric shaft drive.

* * * * *